US006378403B1

(12) United States Patent
Bates et al.

(10) Patent No.: US 6,378,403 B1
(45) **Date of Patent: *Apr. 30, 2002**

(54) UNIVERSAL RETAINING RING PLIER

(75) Inventors: Darryle E. Bates, Cuyahoga Falls; Scott S. Kalanish, Hiram, both of OH (US)

(73) Assignee: Stride Tool, Inc., Ellicottville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/465,555

(22) Filed: Dec. 17, 1999

(51) Int. Cl.[7] ..... B25B 7/12
(52) U.S. Cl. ..... 81/302; 29/229
(58) Field of Search ..... 81/302, 416, 186; 29/225, 229

(56) References Cited

U.S. PATENT DOCUMENTS

| | | | | |
|---|---|---|---|---|
| 1,514,488 A | | 11/1924 | Wernimont | |
| 3,132,550 A | | 5/1964 | Sion | |
| 3,662,449 A | | 5/1972 | Hashimoto | |
| 3,762,019 A | | 10/1973 | Epstein | |
| 4,280,265 A | | 7/1981 | Murphy | |
| 4,476,750 A | | 10/1984 | Murphy | |
| 4,625,379 A | | 12/1986 | Anderson | |
| 5,007,313 A | | 4/1991 | Jeromson, Jr. et al. | |
| 5,174,177 A | | 12/1992 | Jeromson, Jr. et al. | |
| 5,826,467 A | * | 10/1998 | Huang | 81/302 |
| 6,145,417 A | * | 11/2000 | Bates et al. | 81/302 X |

* cited by examiner

*Primary Examiner*—James G. Smith
(74) *Attorney, Agent, or Firm*—Watts, Hoffmann, Fisher & Heinke Coi., L.P.A.

(57) ABSTRACT

A pair of convertible pliers capable of switching between a first configuration suitable for use with external retaining rings to a second configuration suitable for use with internal retaining rings. The pliers convert from external to internal by operation of a pair of pins disposed in the jaws and capable of being maneuvered by a cam surface inside a knob on the tool such that the tool is convertible from a first position where movement of the handles inward causes the jaws to move inward to a second position where movement of the handles inward causes the jaws to move outward.

18 Claims, 4 Drawing Sheets

UNIVERSAL RETAINING RING PLIER

FIELD OF THE INVENTION

The present invention relates generally to plier tools such as retaining or snap ring pliers. More particularly, the present invention relates to pliers of a type which are convertible between a first position which allows the jaws to move inwardly as the handles are moved inwardly, and a second position which allows the jaws to move outwardly as the handles are moved inwardly.

BACKGROUND OF THE INVENTION

Retaining rings are utilized in annular grooves on shafts and ends of shafts to retain bearings, collars, and the like on the shaft. A retaining ring extends circumferentially between a pair of ends which have hubs. The hubs have apertures that receive tips of a plier tool. The force applied by the pliers either spreads the hubs to expand the ring or squeezes the hubs to contract the ring. The plier tool is necessary for installing the retaining ring in and removing the retaining ring from either external or internal grooves.

Accordingly, it is sometimes desirable to squeeze the handles to effect movement of the jaws outwardly to expand the ring. It is at other times desirable to squeeze the handles to effect movement of the jaws inwardly to contract the ring. Thus, it is desirable to provide a plier that is convertible between an external and an internal tool. U.S. Pat. Nos. 4,280,265 and 4,476,750 disclose a pair of retaining ring pliers that utilize a pair of separate co-planar jaws and a pair of separate handles that range about a common fixed pivot point and that are adapted to be changed to alternately engage one handle to one jaw and the other handle to the other jaw and vice versa to permit the changing of the tool from external to internal. Two fulcrum pins are disposed in the jaws and are adapted to alternately engage each set of handles to shift from a position adapted to move the jaws inwardly as the handles are moved inwardly, to a position where the jaws are moved outwardly as the handles are moved inwardly, to a position where the jaws are moved outwardly as the handles are moved inwardly.

Each of the pins disclosed in the above patents has to be independently and manually placed into the correct position. Accordingly, it may be difficult for the user of the pliers of the above patents to slide the pins into position. Accordingly, there is a need for a convertible plier tool that is easier to operate.

SUMMARY OF THE INVENTION

The present invention meets the above-described need by providing a pair of pliers capable of easily switching from a first position, suitable for internal retaining rings, wherein moving the handles inward causes the jaws to move inward to a second position, suitable for external retaining rings, wherein moving the handles inward causes the jaws to move outward.

The conversion of the tool from pliers suitable for internal retaining rings to pliers suitable for external rings is accomplished by a set of independent, coplanar jaws that are secured to rotate about a pivot. The jaws each have a slot defined therein that is disposed about the pivot. A set of handles are also independently and rotatably secured about the pivot. The handles have a pair of slots disposed on opposite sides of the pivot.

When the tool is assembled the jaws are disposed between the two handles such that the slots in the jaws and the slots in the handles are in alignment. A set of pins move up and down in the slots in the jaws such that each pin connects one handle to one jaw. The slots in the handle are disposed on each side of the pivot such that each handle can connect to either jaw by means of the pin. In this manner, each of the handles can be switched from engaging the first jaw to engaging the second jaw by manipulating the pins in the two slots. The pins are only long enough to engage one handle to one jaw. Accordingly, the movement of the pins from one end of the slot to the other end changes the engagement of the jaw from one handle to the other handle.

The motion of the pins to alternate the engagement of the handles to the respective jaws is controlled in the present invention by a set of rotating knobs that are secured to the pivot on opposite sides of the tool. The rotating knobs have a cam surface on the inside that controls a cam follower attached to a pair of bushings. The knobs are connected through the center of the tool such that turning one of the knobs causes the other knob to turn. The bushings are disposed about the pivot and each have a pin depending therefrom. The bushings are disposed adjacent to one another in a nesting fashion and are biased away from each other by a spring. The cam followers on the bushings move inward (perpendicular to the plane defined by the handles) and outward according to the cam surface in the knobs. When the cam surface in the first knob is at maximum amplitude, the pin on the bushing is driven down in the slot into engagement with the jaw and the opposite handle. When the cam surface is at minimum amplitude, the force of the spring causes the pin to engage the jaw to the handle on the same side as the knob.

Accordingly, the present invention provides for smooth operation of the pins through the cam, cam follower, and bushing. By rotating one of the knobs from a first cam position to a second cam position, the tool is changed from a pair of pliers suitable for internal retaining rings to a pair of pliers suitable for external retaining rings.

Other features and advantages of the present invention will become apparent upon reading the following detailed description of embodiments of the invention, when taken in conjunction with the accompanying drawings and the appended claims.

BRIEF DESCRIPTION OF THE DRAWINGS

The invention is illustrated in the drawings in which like reference characters designate the same or similar parts throughout the figures of which.

DETAILED DESCRIPTION OF THE PREFERRED EMBODIMENT

Figure 1:
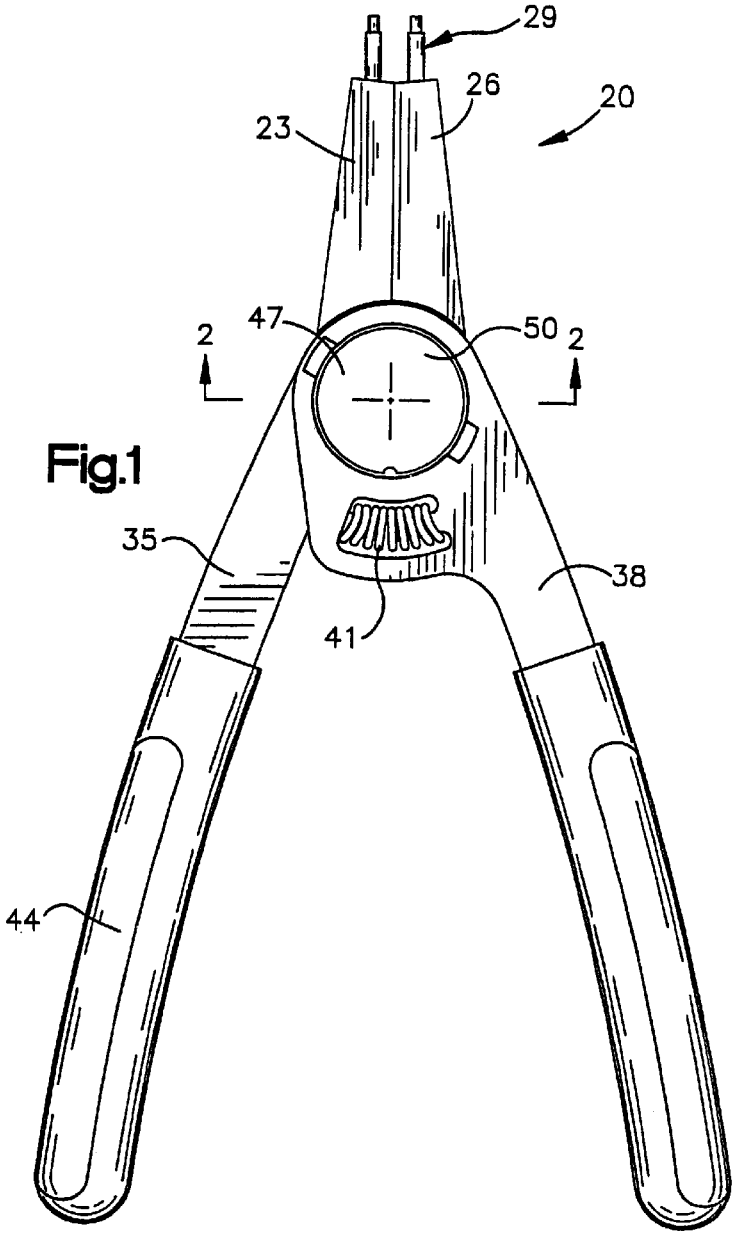
FIG. 1 is a plan view of the pliers of the present invention.

Referring to FIG. 1, a pair of pliers 20 have a first jaw 23 and a second jaw 26. The jaws 23, 26 support a pair of jaw tips 29 that are sized to fit inside apertures in retaining rings. The jaws 23, 26 are independently and rotatably disposed about a pivot 32 (shown in FIG. 16). A pair of handles 35, 38 operate the jaws 23, 26. The handles 35, 38 are disposed about the pivot 32 on opposite sides of the jaws 23, 26. The handles 35, 38 are capable of rotating about the pivot 32 independently of the jaws 23, 26. A spring 41 biases the first handle 35 away from the second handle 38. The handles 35, 38 are preferably equipped with grips 44 that provide padding to the handles 35, 38, which are typically manufactured of a hard metal.

A first knob 47 disposed about the pivot 32 provides for switching between a first position where moving the handles 35, 38 inward moves the jaws 23, 26 inward to a second position where moving the handles 35, 38 inward moves the jaws 23, 26 outward. The first knob 47 has indicia 50 indicating which way to turn the knob 47 to switch from internal to external.

Figure 2:
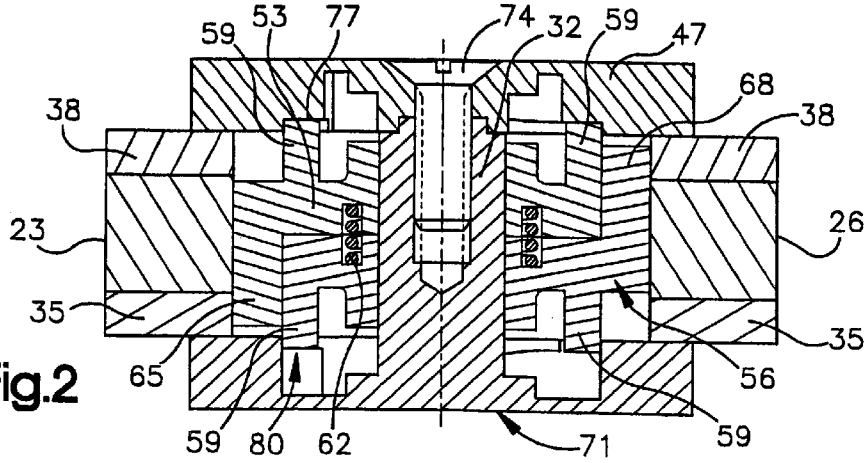
FIG. 2 is a cross-sectional view taken along lines 2—2 of FIG. 1.
Figure 3:
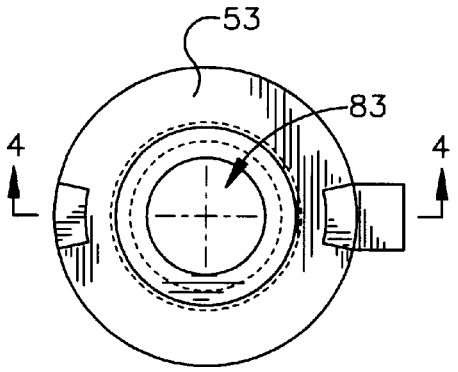
FIG. 3 is a top plan view of the bushing of the present invention.
Figure 5:
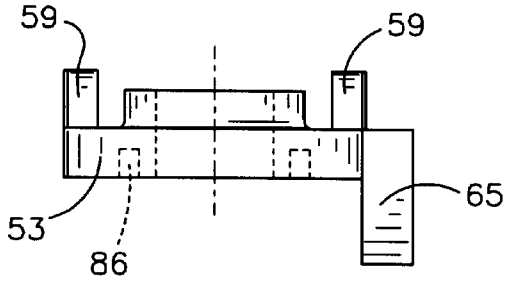
FIG. 5 is a front elevation view of the bushing of the present invention.
Figure 4:
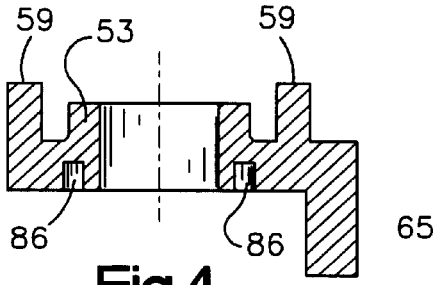
FIG. 4 is a cross-sectional view taken along line 4—4 of FIG. 3.

Turning to FIG. 2, the engagement of the handles 35, 38 to the jaws 23, 26 is controlled by a first bushing 53 and a second bushing 56 that are disposed about the pivot 32. The bushings 53, 56 have cam followers 59. A spring 62 biases the bushings 53, 56 away from each other. The bushings 53, 56 each have a pin 65, 68, respectively, depending therefrom. The pin 65 engages the first jaw 23 to either the first handle 35 or the second handle 38, depending on its position. In the position shown, the pin 65 is engaging the first jaw 23 to the first handle 35. The first knob 47 is attached to a second knob 71 by a fastener 74. The knobs 47, 71 are held together by the fastener which also indirectly holds the handles 35, 38 and the jaws 23, 26 together. The knobs 47,71 both rotate with the pivot 32, and the knobs 47, 71 rotate together due to their fixed attachment.

The knobs 47, 71 have cam surfaces 77,80 that provide movement of the bushings 53, 56 by means of the cam followers 59. In the position shown, the cam surfaces 77, 80 are forcing the bushings 53, 56 inward toward one another causing the first handle 35 to engage with the first jaw 23 through pin 65 and causing the second handle 38 to engage with the second jaw 26 through pin 68. Accordingly, the pliers 20 are in position for external retaining rings. When the knobs 47, 71 are rotated to the internal position, the cam surfaces 77, 80 no longer force the bushings 53, 56 inward and the force of spring 62 moves the bushings 53, 56 outward away from one another. In this position, the first jaw 23 engages with the second handle 38 and the second jaw 26 engages with the first handle 35, resulting in a configuration suitable for internal retaining rings.

Figure 6:
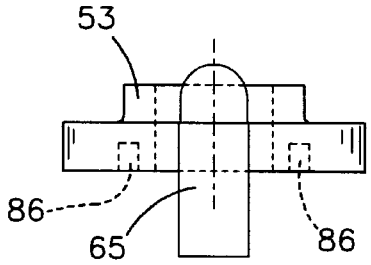
FIG. 6 is a side elevation view of the bushing.

Turning to FIGS. 3–6, the bushings 53 and 56 are preferably identical, and therefore only one of the bushings is described in detail. Bushing 53 has a centrally located opening 83, and bushing 53 is preferably round. In this matter, the bushing 53 is disposed about the pivot 32. The bushing 53 has a pair of cam followers 59 and a pin 65 depending therefrom. The bushing 53 also has a slot 86 for capturing the end of spring 62. The end of each cam follower is preferably radiused as shown in FIG. 6.

Figure 7:
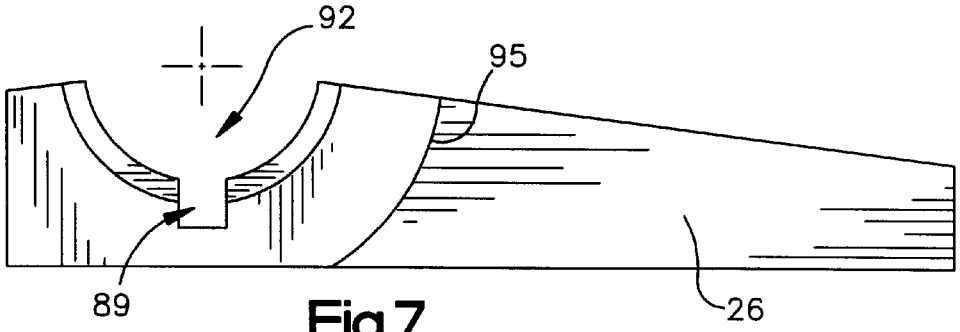
FIG. 7 is a plan view of the jaw.
Figure 8:
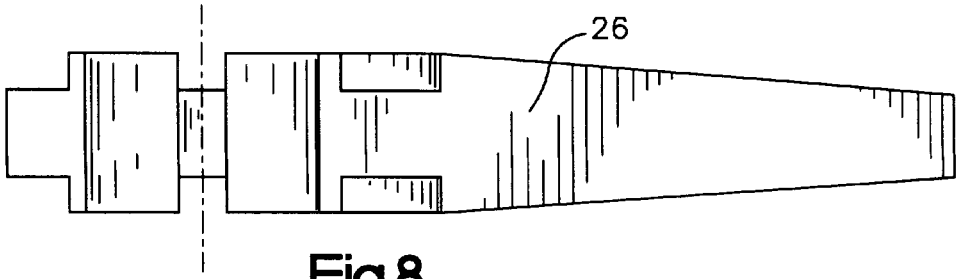
FIG. 8 is a side elevation view of the jaw.

In FIGS. 7–8, the second jaw 26 has a slot 89 that is adjacent to a curved opening 92 that wraps around the pivot 32. The slot 89 is preferably U-shaped and elongate and receives pin 68 in sliding fashion. When the tool 20 is engaged, a portion of pin 68 resides in the slot 89. The remainder of the pin 68 extends into either the first handle 35 or the second handle 38 to connect the respective handle 35 or 38 to the jaw 26 (FIG. 2). The jaw 26 has a curved bearing shoulder 95 that provides a bearing surface for the top of the handles 23, 26 as they rotate about pivot 32 (best shown in FIG. 1). First jaw 23 is symmetrical to second jaw 26 and therefore, it is not described separately.

Figure 9:
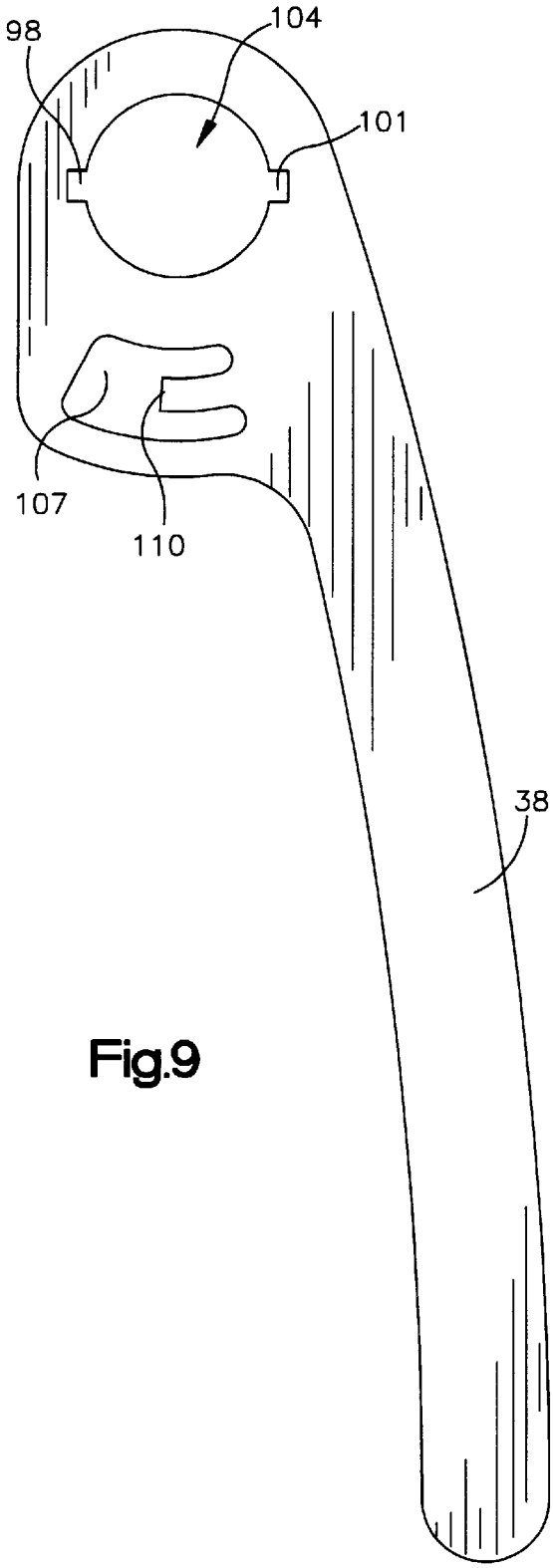
FIG. 9 is a plan view of the handle.

The handles 35, 38 are also symmetrical and can be manufactured identically. One of the handles can then be simply inverted to provide a first handle 35. Accordingly, only one of the handles is described in detail. In FIG. 9, handle 38 has a pair of slots 98 and 101 disposed on opposite sides of a central opening 104. The slots 98, 101 are preferably U-shaped and elongate. The slots 98, 101 align with the slot 89 and the slot in the first jaw. The slots 98, 101 provide a pathway for pins 65, 68 (FIG. 2). When the pins 65, 68 extend through the jaws 23, 26 into the slots 98, 101 in the handles 35, 38 they mechanically engage the handles 35, 38 to the jaws 23, 26 (FIG. 2). By having a slot 98, 101 on each side of the central opening 104, the handle 38 is capable of being connected to either jaw 23, 26 by operation of the pins 65, 68 (FIG. 2). In the center of the handle 38, there is also an opening 107 and a tab 110 for attachment of spring 41 (shown in FIG. 1).

Figure 10:
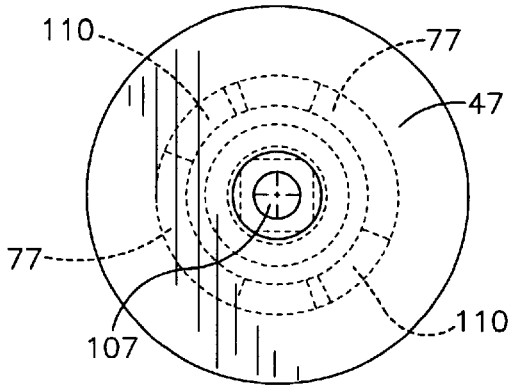
FIG. 10 is a top plan view of the first knob.
Figure 11:
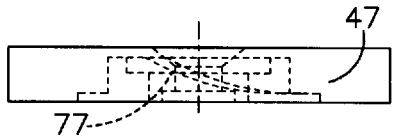
FIG. 11 is a side elevation view of the first knob.
Figure 12:
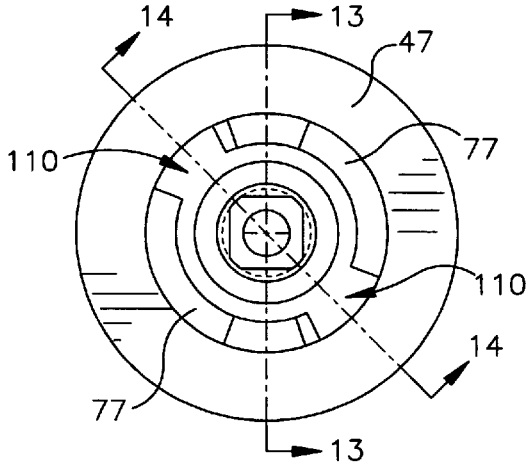
FIG. 12 is a bottom plan view of the first knob.

Turning to FIGS. 10–12, the first knob 47 is preferably round and has a central opening 107 for passage of the fastener 74 (shown in FIG. 2). The cam surface 77 is disposed on the inside surface of knob 47. The cam surface 77 extends around a portion of the circumference of the knob 47 and there are open portions 110. When the knob 47 is rotated about the pivot 32, the cam surface 77 engages with the cam follower 59 on the bushing 53 (FIG. 2). When the rotation of the knob 47 causes the cam follower 59 to reach the open portion 110, the bushing is capable of moving outward under the force of spring 62.

Figure 13:
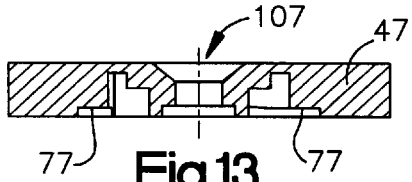
FIG. 13 is a cross-sectional view taken along line 13—13 of FIG. 12.
Figure 14:
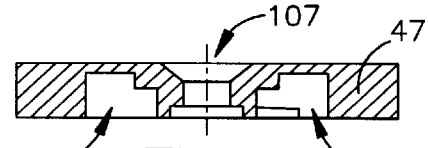
FIG. 14 is a cross-sectional view taken along line 14—14 of FIG. 12.

FIG. 13 illustrates a cross-section of knob 47 when the cam surface 77 is at its maximum amplitude. The opening 107 receives the fastener 74 that holds knob 47, knob 71, and the rest of the components securely about pivot 32. FIG. 14 illustrates the open portion 110 where the cam surface 77 is no longer engaging the cam follower 59 on the bushing 53.

Figure 15:
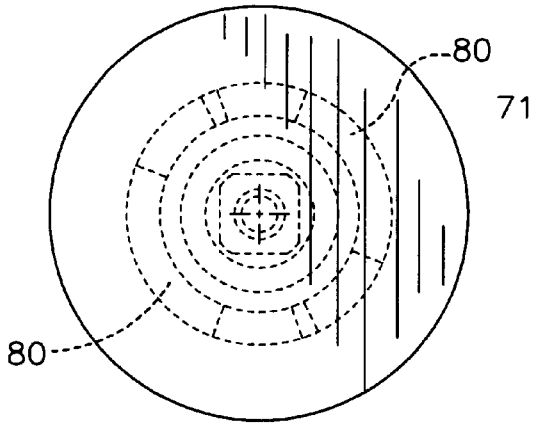
FIG. 15 is a top plan view of the second knob.
Figure 16:
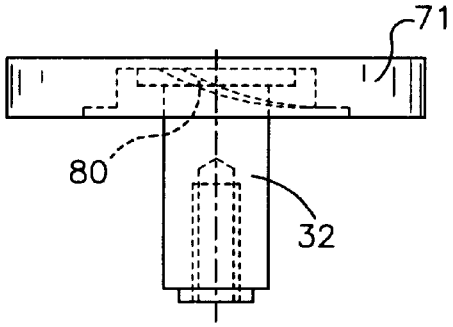
FIG. 16 is a side elevation view of the second knob.
Figure 17:
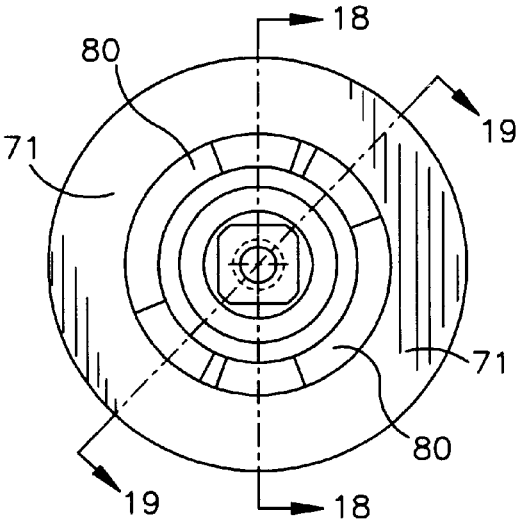
FIG. 17 is a bottom plan view of the second knob.

In FIGS. 15–17, the second knob 71 is integrally formed with the pivot 32, which generally comprises a spindle type, centrally located projection. The pivot 32 receives fastener 74. The pivot 32 extends through the center of the pliers 20 to attach the knobs 47, 71 together and to hold the jaws 23, 26 and handles 35, 38 together (FIG. 2). The knobs 47, 71 are fixedly connected by the fastener 74 and rotate together with the pivot 32 (FIG. 2). Because of their fixed engagement, the knobs 47, 71 are maintained in registry and rotation of the first knob 47 causes the second knob 71 to rotate.

The knob 71 has a cam surface 80 that corresponds to the cam surface 77 on knob 47. Accordingly, rotation of knob 47 to the internal or external position also rotates knob 71 and cam surface 80 into the corresponding internal or external position.

Figure 18:
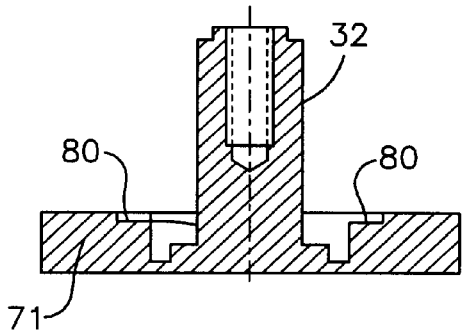
FIG. 18 is a cross-sectional view taken along lines 18—18 of FIG. 17.
Figure 19:
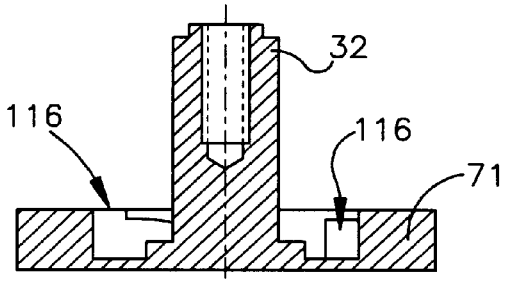
FIG. 19 is a cross-sectional view taken along lines 19—19 of FIG. 17.

FIGS. 18–19 illustrate the positions of knob 71 and the cam surface 80 inside knob 71. In FIG. 19, the cam surface 80 has an open portion 116 that releases the cam follower 59 and enables the spring 62 (shown in FIG. 2) to control the position of the second bushing 56. Turning to FIG. 18, the knob 71 is shown in the position where the cam surface 80 is at maximum amplitude and the cam surface 80 is forcing the follower 59 and bushing 56 inward.

In operation, the knob 47 is rotated between a first position and a second position to change the pliers from internal to external (shown in FIG. 1). In the first position, the cam surfaces 77, 80 hold the bushings 53, 56 inward against the spring 62 such that the pins 65, 68 engage the jaws 23, 26 to the handles 35, 38, respectively. In the second position, the knob 47 is rotated such that the cam surfaces 77, 80 release the cam followers 59. As a result, the spring 62 forces the bushings 53, 56 outward such that pins 65, 68 engage the jaws 23, 26 to the handles 38, 35, respectively.

The present invention advantageously provides the ability to switch from internal to external pliers by rotating a single knob 47. In the prior designs a pin on each side of the tool had to be positioned separately and manually.

While the invention has been described in connection with certain preferred embodiments, it is not intended to limit the scope of the invention to the particular forms set forth, but, on the contrary, it is intended to cover such alternatives, modifications, and equivalents as may be included within the spirit and scope of the invention as defined by the appended claims.

What is claimed is:

1. A plier tool, comprising:

a pivot;

first and second coplanar movable jaws rotatably secured about the pivot;

first and second handles rotatably secured about the pivot;

at least two pins respectively slidably disposed in the first and second jaws, the pins each having a respective cam follower operatively associated therewith; and, at least one knob attached to the pivot and having a cam surface thereon capable of engaging the cam followers such that the pins are movable axially and circumferentially from a position where one of the at least two pins connects the first jaw to the first handle and the other of the at least two pins connects the second jaw to the second handle to a position where said one of the at least two pins connects the first jaw to the second handle and said other of the at least two pins connects the second jaw to the first handle.

2. The plier tool of claim 1, wherein the first and second jaws each have a slot formed therein.

3. The plier tool of claim 2, wherein the slots are U-shaped and elongate.

4. The plier of tool of claim 1, wherein the first and second handles each have a slot formed therein.

5. The plier of tool of claim 4, wherein the slots are U-shaped and elongate.

6. The plier tool of claim 1, wherein the handles are biased away from each other by a spring.

7. The plier tool of claim 1, wherein the pins are operatively associated with the cam followers by a bushing.

8. The plier tool of claim 7, wherein the bushing is round and has a centrally located opening disposed therein.

9. The plier tool of claim 1, wherein the pins are operatively associated with the cam followers by a pair of bushings that are spring biased away from each other.

10. The plier tool of claim 9, wherein the bushings are round and have a central opening defined therein capable of receiving the pivot therethrough.

11. The plier tool of claim 1, further comprising:

a second knob integrally formed with the pivot and disposed such that rotation of the first knob produces rotation of the second knob.

12. The plier tool of claim 11, wherein the second knob has a cam surface thereon capable of engaging one of the cam followers.

13. A plier tool, comprising;

a pivot;

first and second coplanar jaws movably secured about the pivot, the first and second jaws each having a slot defined therein;

first and second handles rotatably secured about the pivot and each handle having at least two slots defined therein;

a first bushing disposed about the pivot, the first bushing having at least one cam follower and having a depending pin;

a second bushing disposed about the pivot axially opposite the first bushing, the second bushing also having at least one cam follower and having a depending pin;

a spring disposed between the first and second bushing;

a first know attached to the pivot and having a cam surface capable of engaging the cam follower on the first bushing such that movement of the cam surface causes the pin to move inside the slots in the first and second handles and first jaw against the force of the spring;

a second knob extending from the pivot and having a cam surface capable of engaging the cam follower on the second bushing such that movement of the cam surface causes the pin to move inside the slots in the first and second handles and second jaw against the force of the spring;

whereby rotation of the first and second knobs causes the pins to move from a first position wherein the first handle and the first jaw and the second handle and the second jaw are operably secured to move the jaws outwardly as the handles move inwardly to a second position wherein the first handle and the second jaw and the second handle and the first jaw are operably secured to move the jaws inwardly as the handles are moved inwardly.

14. The plier tool of claim 13, wherein the handles er biased apart from one another by a second spring.

15. The plier tool of claim 13, wherein certain of the slots are U-shaped.

16. The plier tool of claim 13, wherein the first and second bushings are round and have a centrally located opening defined therein.

17. The plier tool of claim 13, wherein the second knob is formed integrally with the pivot.

18. The plier tool of claim 13, wherein the first knob has indicia corresponding to the position of the pins.

* * * * *